United States Patent [19]

Nakanishi

[11] Patent Number: 5,050,345

[45] Date of Patent: Sep. 24, 1991

[54] WINDOW

[75] Inventor: Yoshikazu Nakanishi, Tokyo, Japan

[73] Assignee: Nakanishi Engineering Co., Ltd., Tokyo, Japan

[21] Appl. No.: 458,287

[22] Filed: Dec. 28, 1989

[30] Foreign Application Priority Data

Dec. 28, 1988 [JP] Japan ..... 63-329271

[51] Int. Cl.[5] ..... E05F 11/02

[52] U.S. Cl. ..... 49/279; 49/83; 49/260; 49/345

[58] Field of Search ..... 49/279, 280, 281, 291, 49/292, 339, 341, 345, 83, 260

[56] References Cited

U.S. PATENT DOCUMENTS

| | | | |
|---|---|---|---|
| 1,748,662 | 2/1930 | Stewart | 49/341 |
| 2,926,397 | 3/1960 | Vuncannon | 49/85 |
| 2,981,538 | 4/1961 | Bennett | 49/341 |
| 3,071,219 | 1/1963 | Vuncannon | 49/341 |
| 3,257,755 | 6/1966 | Lewis | 49/345 |
| 3,420,000 | 1/1969 | Esser | 49/280 |
| 3,438,151 | 4/1969 | Evers et al. | 49/345 |
| 4,301,622 | 11/1981 | Dunsmoor | 49/345 X |
| 4,361,985 | 12/1982 | DeMarco | 49/281 X |
| 4,703,960 | 11/1978 | Lense | 49/280 X |
| 4,823,508 | 4/1989 | Allen | 49/341 X |

FOREIGN PATENT DOCUMENTS

| | | | |
|---|---|---|---|
| 51445 | 12/1911 | Austria | 49/279 |
| 20511 | 10/1899 | Switzerland | 49/281 |
| 2081804 | 2/1982 | United Kingdom | 49/345 |
| 2083131 | 3/1982 | United Kingdom | 49/345 |

*Primary Examiner*—Gary L. Smith
*Assistant Examiner*—Michael J. Milano
*Attorney, Agent, or Firm*—Emmanuel J. Lobato; Robert E. Burns

[57] ABSTRACT

A window stay is provided for a casement window so that its window sash is shifted outwardly from the window frame as it is being opened. The window stay comprises a first arm, a second arm and a third arm associated with a driving rod. The first arm has points pivotally attached to the window sash and the window frame and swings the window sash in relation to the window frame as the driving rod is operated. The second arm has points respectively pivotally attached to the window sash and the driving rod swings the window sash in relation to the first arm as the driving rod is operated. The third arm has points respectively pivotally attached to the first arm and the driving rod and swings the first arm in relation to the window frame in accordance with the movement of the driving rod. The window stay is provided with a lock for the window sash, operated by the acting rod. A differential structure is provided between the driving rod and the acting rod by which the window sash is unlocked before being opened and locked after being closed.

9 Claims, 7 Drawing Sheets

WINDOW

BACKGROUND OF THE INVENTION

This invention relates to a casement-type window, in which the window sash is shifted outwardly from the window frame by a window stay while the window is being opened.

There is a known window in which a window stay comprising a pair of arms is employed to swingably connect a window sash to a window frame. While a first arm is used to shift the window sash outwardly from the window frame, a second arm is used to swing the window sash with respect to the first arm.

While the window stay is designed for use in pushing or pulling the window sash to open or close, it has been found that it is not easy to open or close a large heavy window sash against wind pressure. On occasion, the user may also have to take the risk of leaning out of the window.

Another known window stay is designed to open or shut a plurality of interlocked window sashes with one crank handle. The difficulty in this case is that the window stay is unable to increase the lead-out distance of the window sashes and to open or close the window sashes easily.

Still another known window is provided with a locking means for window sashes. However, it is required to be locked or unlocked manually whenever the window sash is opened or closed, thus the operation thereof is cumbersome.

SUMMARY OF THE INVENTION

An object of the present invention is to provide a window with a window stay capable of firmly holding a window sash in an open position, assuring the opening or closing of the window sash with safety and ease, and increasing the lead-out distance of the window sash.

Another object of the present invention is to provide a window sash capable of readily opening or closing a plurality of interlocking window sashes with a greater lead-out distance by means of one crank handle.

Still another object of the present invention is to provide a window with a lock which is automatically locked or unlocked in accordance with the opening or closing operation of the window sash.

A further object of the present invention is to provide a window having a single window sash or a plurality, two or more, of interlocked window sashes and a locking means which can be locked or unlocked in a closed position of the window sashes by use of one crank handle which is used for opening or closing.

To accomplish the aforesaid objects, the present invention provides a window stay comprising a first arm for swingably connecting a window sash to a window frame, a second arm for swinging the window sash with respect to the first arm, and a third arm for swinging the first arm with respect to the window frame. A driving rod is connected to the second arm and third arm and is reciprocated so that the three arms operate to open or close the window sash. The window stay is further provided with a latch mounted to the window sash and a locking bolt which engages with the latch. An acting rod is connected to the locking bolt and is reciprocated so that the locking bolt may be engaged with or released from the latch. The window stay is further provided with a crank handle used for reciprocating the driving rod and the acting rod. A differential means is provided between the driving rod and the acting rod so that the acting rod may precede the driving rod in order to release the locking bolt from the latch and the acting rod may follow the driving rod or the acting rod may be delayed in order to engage the locking bolt with the latch.

A plurality of window stays may be respectively provided for a plurality of interlocking parallel window sashes. These window stays are connected to a common driving rod and acting rod. The driving rod and acting rod are operated by a crank handle.

The window stays may be respectively provided at the top and bottom parts of a window sash; and such window stays may be interconnected by a power transmitting shaft and also be operated by a crank handle.

BRIEF DESCRIPTION OF THE DRAWINGS

The present invention will now be described with reference to the accompanying drawings, in which.

DETAILED DESCRIPTION OF THE PREFERRED EMBODIMENT

Figure 1:
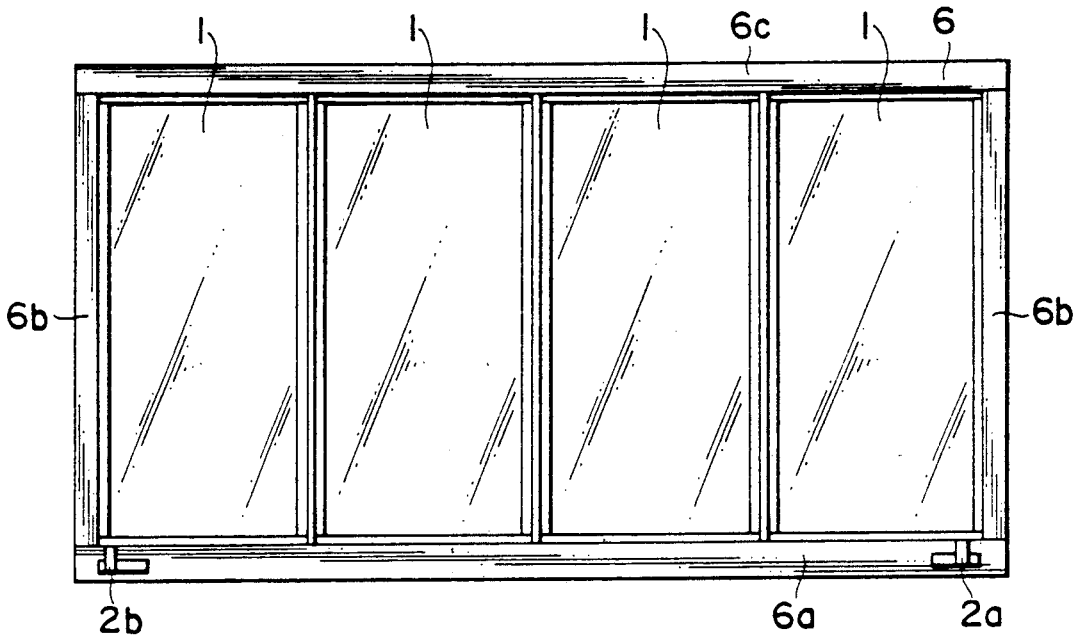
FIG. 1 is a front elevation view, on a reduced scale, of a window embodying the present invention.
Figure 7:
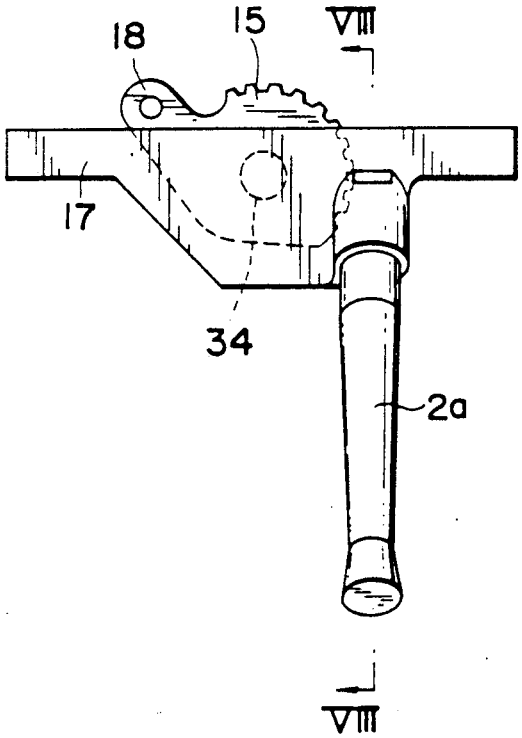
FIG. 7 is a plan view of a crank handle for use in operating the window stays.
Figure 8:
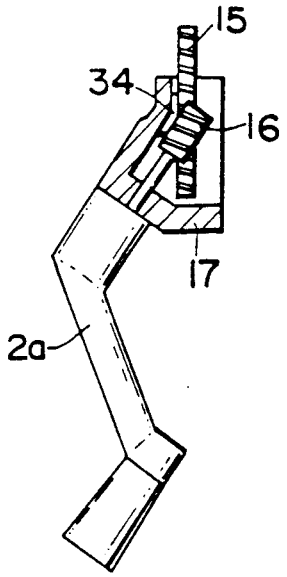
FIG. 8 is a sectional view taken on line VIII—VIII of FIG. 7.

FIG. 1 shows a window frame having four parallel, interlocking window sashes 1. The two right-hand window sashes 1 are opened and closed by a right-hand crank handle 2*a*, while the two left-hand sashes 1 are opened and closed by a left-hand crank handle 2*b*.

Figure 2:
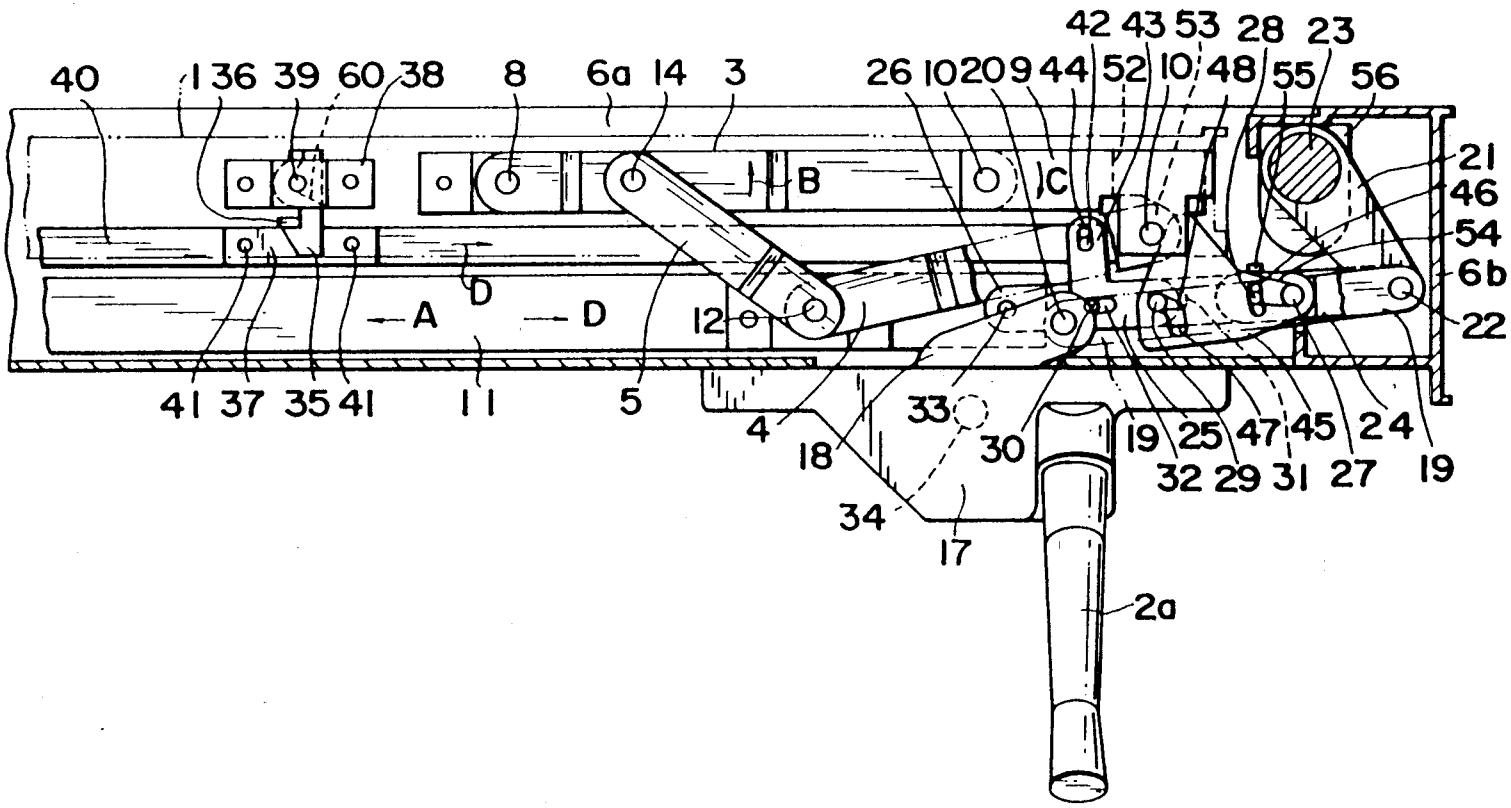
FIG. 2 is a plan view, with parts in section and with parts cut away, illustrating the window stay in a closed position in the bottom portion of a window frame in which the locking means is in a locked position.

Window stays are respectively provided at the top and bottom parts or sides of each of the window sashes 1, which is shifted outwardly from the window frame by swinging the window sash 1 around a fixed pivot point 8 (hereinafter pin 8) and also swinging the window sash with respect to a movable pivot point 10 (hereinafter, pin 10) (FIG. 2).

The window stay shown in FIGS. 2 to 5 and FIG. 9 is respectfully attached to the bottom of each window sash 1 and is provided with a first arm 3, a second arm 4 and a third arm 5. One end of the first arm 3 is pivotally attached by the pin 8 to a first mounting plate 7 fixed to the bottom side 6*a* of the window frame 6; and the other end of the first arm 3 is pivotally attached by the pin 10 to a second mounting plate 9 fixed to the bottom side of the window sash 1. The first arm 3 serves to swing the window sash 1 around the pin 8 from the open position to the closed position and vice versa. One end of the second arm 4 is pivotally attached to a driving rod 11 by a pin 12; and the other end of the second arm 4 is pivotally attached by a pin 13 to the second mounting plate 9 fixed to the bottom side of the window sash. The second arm 4 serves to swing the window sash 1 about the pin 10 of the first arm 3.

The driving rod 11 in the form of a long, narrow strip is incorporated in the bottom side 6*a* of the window frame 6 in such a manner as to extend in the longitudinal direction of the bottom side of the window frame. The driving rod 11 is movable in either longitudinal direction. The reciprocatory movement of the driving rod 11 serves to swing the window sash I about the pin 10 via the second arm 4.

One end of the third arm 5 is pivotally attached by a pin 14 to the first arm 3 at a point between the ends of the first arm; and the other end of the third arm 5 is pivotally attached to the driving rod 11 by the pin 12 also used for the second arm 4. The other end of the third arm 5 may optionally be pivotally attached to the driving rod 11 by a separate pin (not shown) set apart from the pin 12. This third arm 5 swings the first arm 3 around the pin 8 as the driving rod 11 is reciprocated.

Figure 5:
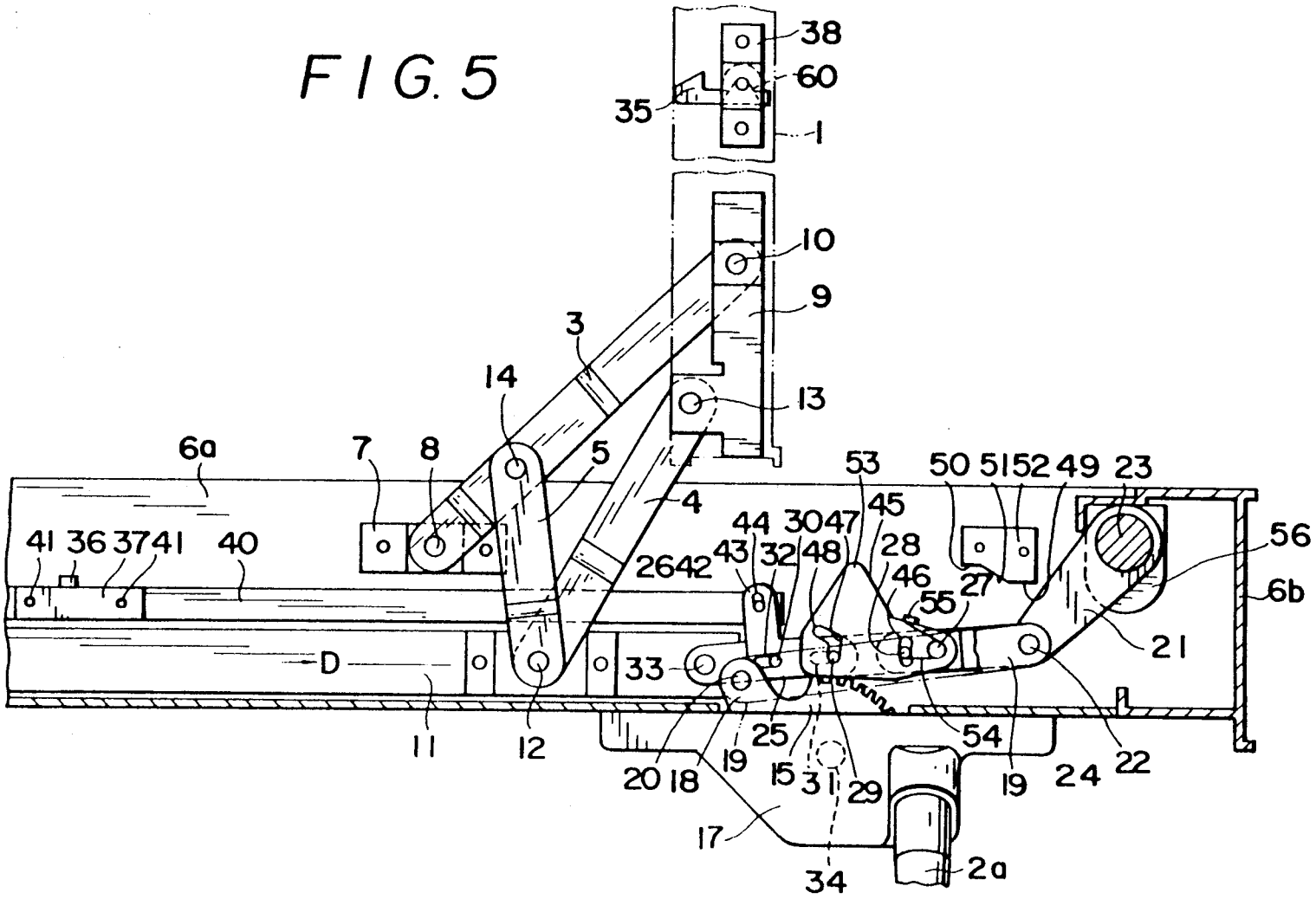
FIG. 5 is a plan view similar to FIG. 2, illustrating a window stay in a full opened position.

The window sash 1 shown in FIG. 2 is in a closed position. When the driving rod 11 is moved in the direction of arrow A, when the sash is closed, the third arm 5 swings the first arm 3 at the pin 8 in the direction of arrow B and consequently causes the window sash 1 to swing about the pin 8 in the same direction. Simultaneously, the second arm 4 is caused to swing with the window sash 1 at pin 10 in the direction of arrow C. Accordingly, the window sash 1 is, as shown in FIG. 5, opened in the direction perpendicular to the bottom side 6*a* of the window frame and is shifted outwardly from the bottom window frame side 6*a* so that a gap or space is formed between the outside surface of the window sash 1 and a vertical side 6*b* of the window frame. This space allows good ventilation and at the same time makes it possible to clean the exterior surface of the window sash.

When the driving rod 11 is moved in the direction D opposite to the arrow A when the window sash 1 is in the open position, each of the arms 3, 4 and 5 respectively swings in the direction opposite to the opening movement so that the window sash 1 is closed at the bottom side 6*a* of the window frame 6.

The driving rod 11 is driven by a driving mechanism having a worm wheel 15, a worm 16 meshing with the worm wheel 15. The worm wheel 15 and the worm 16 are enclosed in a housing 17. The crank handle 2*a* is rotatably mounted on the housing 17 for rotation of the worm 16, and a driving arm 18 extends radially from the worm wheel 15 and is pivotally attached by a pin 20 to one end of a transmitting rod 19. The other end of the transmitting rod 19 is pivotally attached by a pin 22 to one end of a crank arm 21 fixed to a transmitting shaft 23 in such a manner as to rotate jointly therewith.

Figure 6:
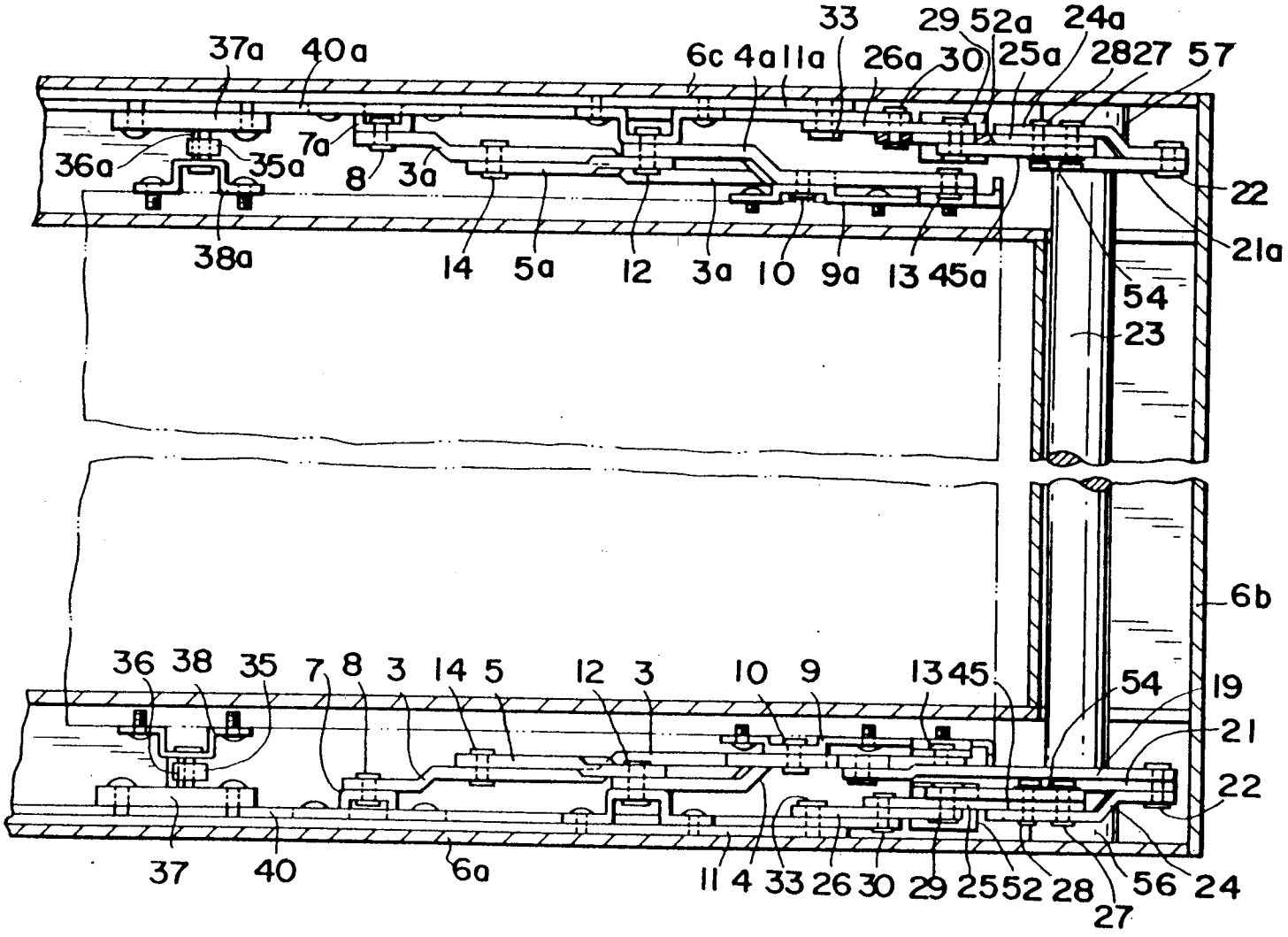
FIG. 6 is a front elevation view showing a window stay in its closed position with parts in section and with parts cut away.

The crank arm 21 and driving rod 11 are connected by a first connecting rod 24, a second connecting rod 25 and a third connecting rod 26. One end of the first connecting rod 24 is pivotally attached to one end of the crank arm 21 by the common pin 22. Another end of the first connecting rod 24 is integrally fixed to one end of the second connecting rod 25 by pins 27 and 28. The third connecting rod 26 has pins 29 and 30 extending therefrom at one end and an intermediate point thereof, and these pins are inserted in elongated slots 31 and 32 at one end and intermediate point of the second connecting rod 25 to connect the second connecting rod 25 and the third connecting rod 26 with a play so that these rods can be relatively moved in a longitudinal direction. Another end of the third connecting rod 26 is pivotally attached to the driving rod 11 by a pin 33 (FIG. 6).

When the crank handle 2*a* is rotated, the driving arm 18 is rotated on a shaft 34 via the worm 16 and the worm wheel 15. The driving arm 18 rotates the crank arm 21 via the transmitting rod 19, and the crank arm 21 reciprocates the driving rod 11 via the first, second and third connecting rods 24, 25 and 26. The window sash 1 is thereby locked by the worm gearing and thus is unable to rotate from the window sash side and is immovably held in any desired open position.

The window sashes 1 are each provided with locking means for locking them in their closed position. The locking means comprises a latch 35 and a locking bolt 37 which has an engaging portion 36 engaging with the latch. The latch 35 is pivotally attached by a pin 39 a third mounting plate 38 fixed on the bottom of the window sash 1. The latch 35 is urged by a spring 60 in a clockwise direction for engaging with an engaging portion 36. The locking bolt 37 is fixed by a pin 41 to an acting rod 0 which is in the form of a long, narrow strip. The acting rod 40 has a pin 42 extending therefrom on one end thereof and the pin 42 is used for connecting the acting rod 40 with the second connecting rod 25 by inserting the pin 42 in an elongated slot 44 of a bend portion 43 of the second connecting rod 25. Accordingly, the acting rod 40 reciprocates in the longitudinal direction integrally with the first and second connecting rods 24 and 25.

A swing plate or pivotal plate 45 is pivotally attached to the second connecting rod 25 by the pin 27, and has an arcuate slot 46 having its center at the pin 27, an arcuate slot 47 having its center at the pin 27 and an elongated slot 48 which joins with the arcuate slot 47 and extends in a slant or substantially radial direction. The arcuate slot 46 is fitted on the pin 28 and enables the swinging of the swing plate 45. The arcuate slot 47 and elongated slot 48 are fitted on the pin 29. When the elongated slot 48 moves relatively while fitting on the pin 29, the power of the swing plate 45 is not transmitted to the pin 29. Accordingly, even if the swing plate 45 moves, the third connecting rod 26 does not move together with it and thus keeps the driving rod 11 in an immovable state. When the arcuate slot 47 moves radially while engaged with the pin 29, it moves the driving rod 11 together via the third connecting rod 26.

A differential means between the second connecting rod 25 and the swing plate 45 with respect to the third connecting rod 26 can be given by a play between the pins 29 and 30 and the elongated slots 31 and 32 and a play between the pin 29 and the elongated slot 48.

The window stay of the present invention is provided with a cam 52 having cam surfaces of a higher surface 49, a lower surface 50 and a slope 51 interconnecting them, as a means for moving relatively the pin 29 from the elongated slot 48 to the arcuate slot 47 or vice versa. The cam 52 is fixed on a bottom side 6*a* of the window frame. On the cam surfaces, a projected portion 53 of the swing plate 45 is pushed by a spring 54 to contact each other. The spring 54 has an intermediate portion rolled around the pin 27, one end rolled around the pin 28 and another end engaged with the projection 55 of the swing plate 45 in order to urge the swing plate 45 in a clockwise direction.

When the window sash 1 is closed (FIG. 2), the engaging portion 36 of the locking bolt 37 is engaged with the latch 35 to lock the window sash 1, the projected portion 53 of the swing plate 45 contacts with the higher surface 49 of the cam 52, the pin 29 of the third connecting rod 26 exist at the left-hand of an elongated slot 48 of the swing plate 45, and the pins 29 and 30 of the third connecting rod 26 exist at the left-hand of the elongated slots 31 and 32 of the second connecting rod 25.

Figure 3:
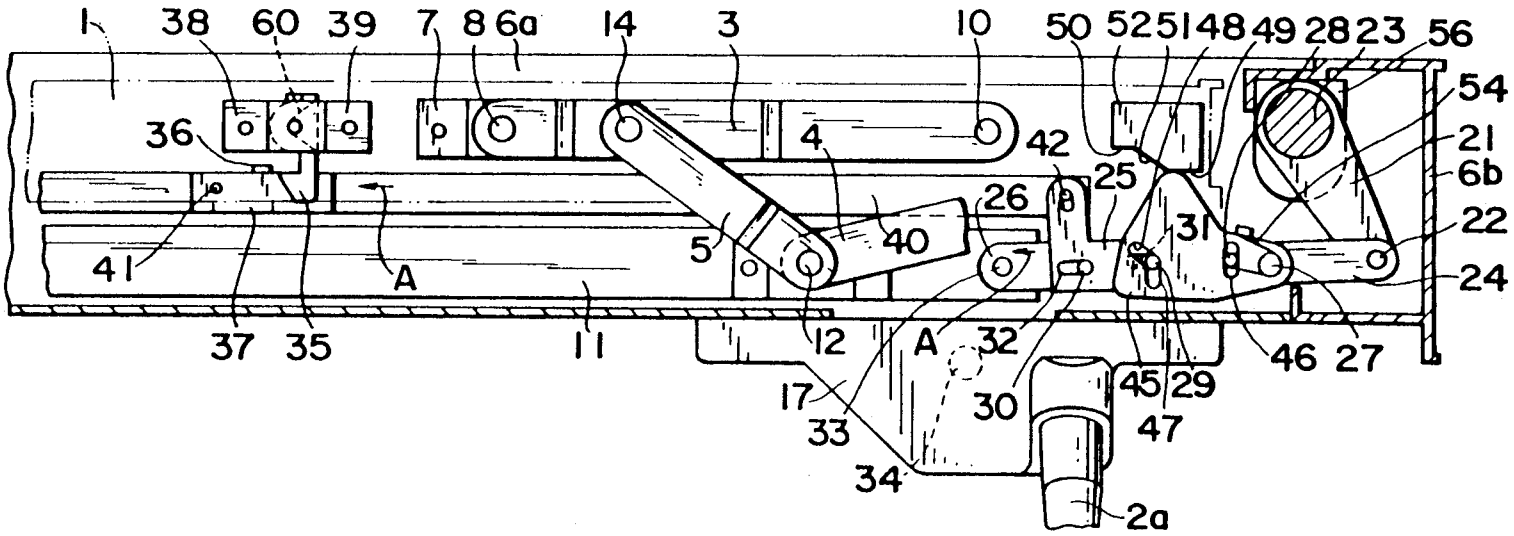
FIG. 3 is a plan view similar to FIG. 2, illustrating a window stay in a closed position, in which the locking means is in the unlocked position.
Figure 4:
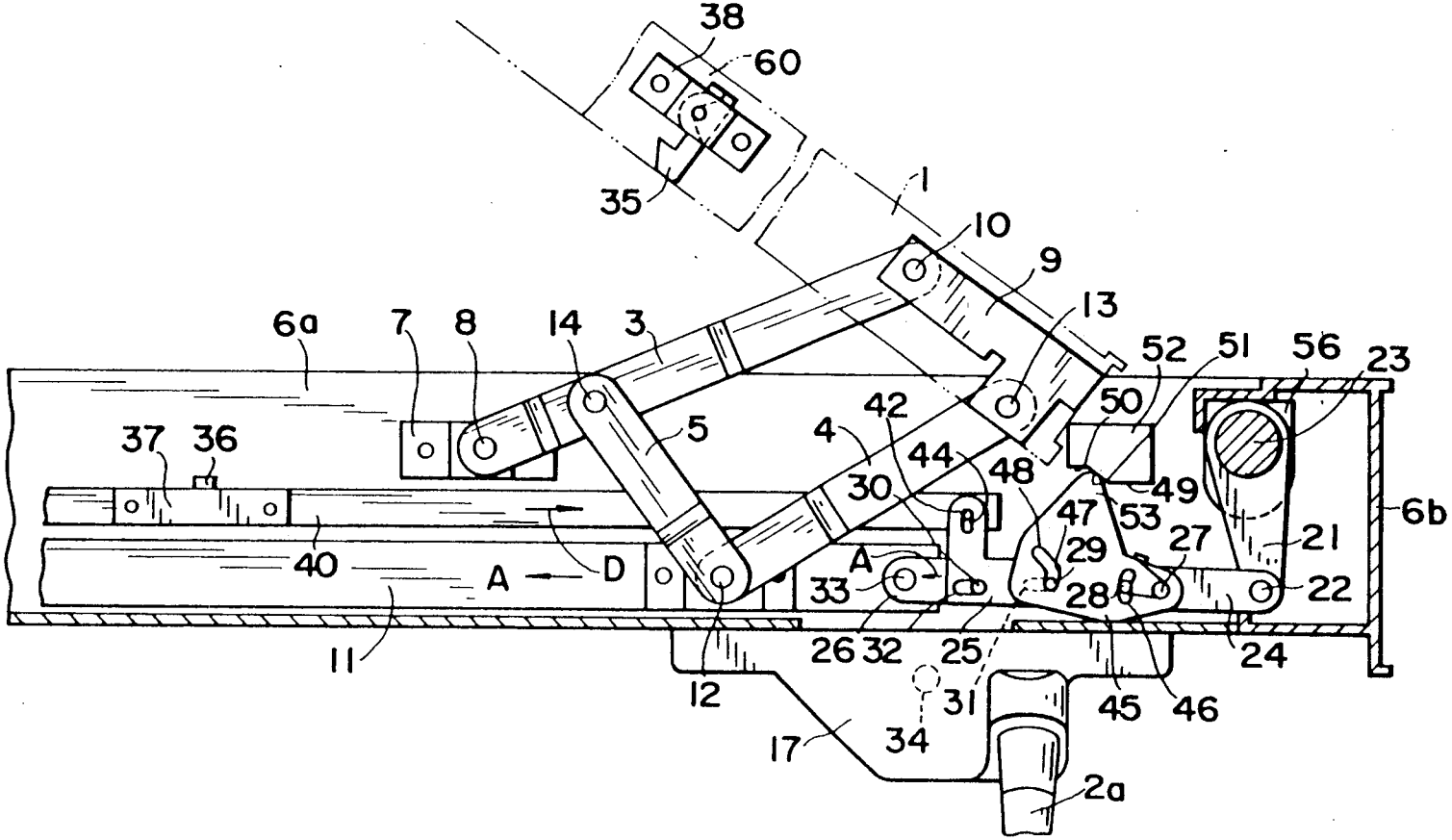
FIG. 4 is a plan view similar to FIG. 2, illustrating a window stay in a partially closed position.

When the crank arm 21 is slightly swung by the crank handle 2*a* via the driving arm 18 and the transmitting rod 19 for opening the window sash 1 (FIG. 3), the first and second connecting rods 24 and 25 are moved in the direction of arrow A, the acting rod 40 is moved together in the direction of arrow A, and the engaging portion 36 of the locking bolt 37 is released from the latch 35. The window sash 1 is thus unlocked. During this operation, the projected portion 53 of the swing plate 45 is moved integrally with the second connecting rod 25 and the projected portion 53 of the swing plate 45 reaches the slope 51 from the higher surface 49 of the cam 52, simultaneously the pin 29 of the third connecting rod 26 moves or slides relatively from the elongated slot 48 to the arcuate slot 47 of the swing plate 45, at the same time, the pins 29 and 30 of the third connecting rod 26 move relatively in the elongated slots 31 and 32 of the second connecting rod 25 to the right end of the slots, respectively. Accordingly, the driving rod 11 rests and the window sash 1 does not open until the engaging portion 36 of the locking bolt 37 is released from the latch 35 via the acting rod 40 (FIG. 3). Once the engaging portion 36 of the locking bolt 37 is released from the latch 35, either one or both of right ends of the elongated slots 31 and 32 of the second connecting rod 25 push the pins 29 and 30 in the direction of arrow A (FIG. 4), and move the driving rod 11 in the same direction via the third connecting rod 26. At that time, the driving rod 11 moves together with the acting rod 40 until the window sash 1 is opened. The swing plate 45, with the movement of the projected portion 53 on the slope 51 of the cam 52 toward the lower surface, swings in a clockwise direction and the arcuate slot 47 slides with respect to the pin 29 and the end of the arcuate slot 47 runs to the pin 29 (FIG. 4).

When the crank handle 2*a* is rotated in a direction to which the window sash 1 closes (FIG. 5), the arcuate slot 47 of the swing plate 45 pulls the pin 29 in the direction of arrow D with the third connecting rod 26, to move the driving rod 11 in the same direction. Once the window sash 1 is completely closed (FIG. 3), the latch 35 reaches the locked position, the projected portion 53 of the swing plate 45 gets on the higher surface 49 of the cam 52 from the slope 51, and then the swing plate 45 is swung in a counter-clockwise direction around the pin 27. Consequently, the arcuate slot 47 is released from engagement with the pin 29, and the elongated slot 48 slides with respect to the pin 29 and simultaneously the elongated slots 31 and 32 slide with respect to the pins 29 and 30 (FIG. 3). As a result, the second connecting rod 25 and the swing plate 45 move with respect to the third connecting rod 26, the driving rod 11 is kept in the closed position, the second connecting rod 25 moves the acting rod 40 together in the direction of arrow D and makes the engaging portion 36 of the locking bolt 37 to be engaged with the latch 35 (FIG. 2).

The transmitting shaft 23 is incorporated within the vertical hollow side 6*b* of the window frame by means of bearing brackets 56 and 57 and extends from the bottom to the top of the vertical side 6*b*. The top of the transmitting shaft 23 is connected to a top stay provided at the top side of the window sash 1 via a crank arm 21*a* and a fourth, a fifth and a sixth connecting rods 24*a*, 25*a* and 26*a*.

The crank arm 21*a*, the fourth, fifth, and sixth connecting rods 24*a*, 25*a* and 26*a* and a second stay at the top side of the window sash 1 constitute a combination corresponding or similar to that of the crank arm 21, the first, second and third connecting rods 24, 25 and 26 and the stay at the bottom side of the window sash.

The crank arm 21*a* is fastened to the top of transmitting shaft 23. One end of the fourth connecting rod 24*a* is pivotally attached to one end of the crank arm 21*a* by a pin 22. The other end of the fourth connecting rod 24*a* is integrally fixed to one end of the fifth connecting rod 25*a* by pins 27 and 28. The sixth connecting rod 26*a* has pins 29 and 30 fixed on one end and intermediate point thereof. These pins 29 and 30 are each slidably inserted into elongated slots 31 and 32 at the other end and intermediate point of the second connecting rod 25*a*, whereby the fifth connecting rod 25*a* and the sixth connecting rod 26*a* are connected so that these have a play that enables them to move in directions opposite to each other along a longitudinal direction. The other end of the sixth connecting rod 26*a* is pivotally attached by a pin 33 to one end of a driving rod 11*a* (FIG. 6). Regarding the stay, one end of a first arm 3*a* is pivotally attached by a pin 8 to a first mounting plate 7*a* fixed to the top side 6*c* of the window frame; and the other end is pivotally attached by a pin 10 to a second mounting plate 9*a* fixed to the top side of the window sash 1. Similarly to the bottom first arm 3, the top first arm 3*a* also swings the mounting plate 9*a* together with the window sash 1 around the pin 8.

One end of a second arm 4*a* is pivotally attached by a pin 12 to a driving rod 11*a*in the top side of the window frame; and the other end of the second arm 4*a* is pivotally attached to a mounting plate 9*a* by a pin 13. Similarly to the bottom second arm 4, the top second arm 4*a* also swings the mounting plate 9*a*together with the window sash 1 at the pin 10.

One end of the third arm 5*a* is pivotally attached to the driving rod 11*a* by the pin 12 also used for the second arm 4*a*. The other end of the third arm 5*a* is pivotally attached by pin 14 to the first arm 3*a* at a point between both ends of the first arm 3*a*. Similarly to the bottom third arm 5, the top third arm 5*a* also swings the first arm 3*a* at the pivot pin 8. When the crank handle 2*a* is rotated, the top crank arm 21*a* swings together with the bottom crank arm 21 via the transmitting shaft 23 and operates the top first, second and third arms 3*a*, 4*a* and 5*a* simultaneously with the bottom arms 3, 4 and 5 so as to open or close the window sash 1.

A locking means is also provided at the upper side of the window sash and it is constituted similarly to the bottom locking means. A latch 35*a* is mounted on the top of the window sash 1 by a third mounting plate 38*a*. A locking bolt 37*a* having an engaging portion 36*a* engaged with the latch is fixed to a acting rod 40*a*. The acting rod 40*a* is provided in the top side 6*c* of the window frame and pivotally attached to the fifth connecting rod 25*a* by a pin 42. A swing plate 45*a* is pivotally attached to the fifth connecting rod 25*a* by a pin 27. A pin 29 of the sixth connecting rod 26*a* is fitted in the arcuate slot 47 and the elongated slot 48 of the swing plate 45*a* and the elongated slot 31 of the fifth connecting rod 25*a*. A cam 52*a* for swinging the swing plate 45*a* is fixed to the top side 6*c* of the window frame.

The top locking means operates as follows, similarly to the bottom locking means. When the window sash 1 is completely closed, the engaging portion 36*a* of the locking bolt 37*a* is engaged with the latch 35*a* to lock the window sash 1 When the window sash 1 is opened by the crank handle 2*a*, the acting rod 40*a* releases the engaging portion 36*a* from the latch 35*a* prior to the driving rod 11*a* and then the driving rod 11*a* moves together with the acting rod 40*a* to open the window sash 1. When the window sash 1 is closed, the driving rod 11*a* closes the window sash 1 prior to the acting rod 40*a* near the closed position to completely close the window sash 1 and moves the latch 35*a* to the closed position, and then the acting rod 40*a* moves to engage the latch 35*a* with the engaging portion 36*a* of the locking bolt 37*a*.

Figure 9:
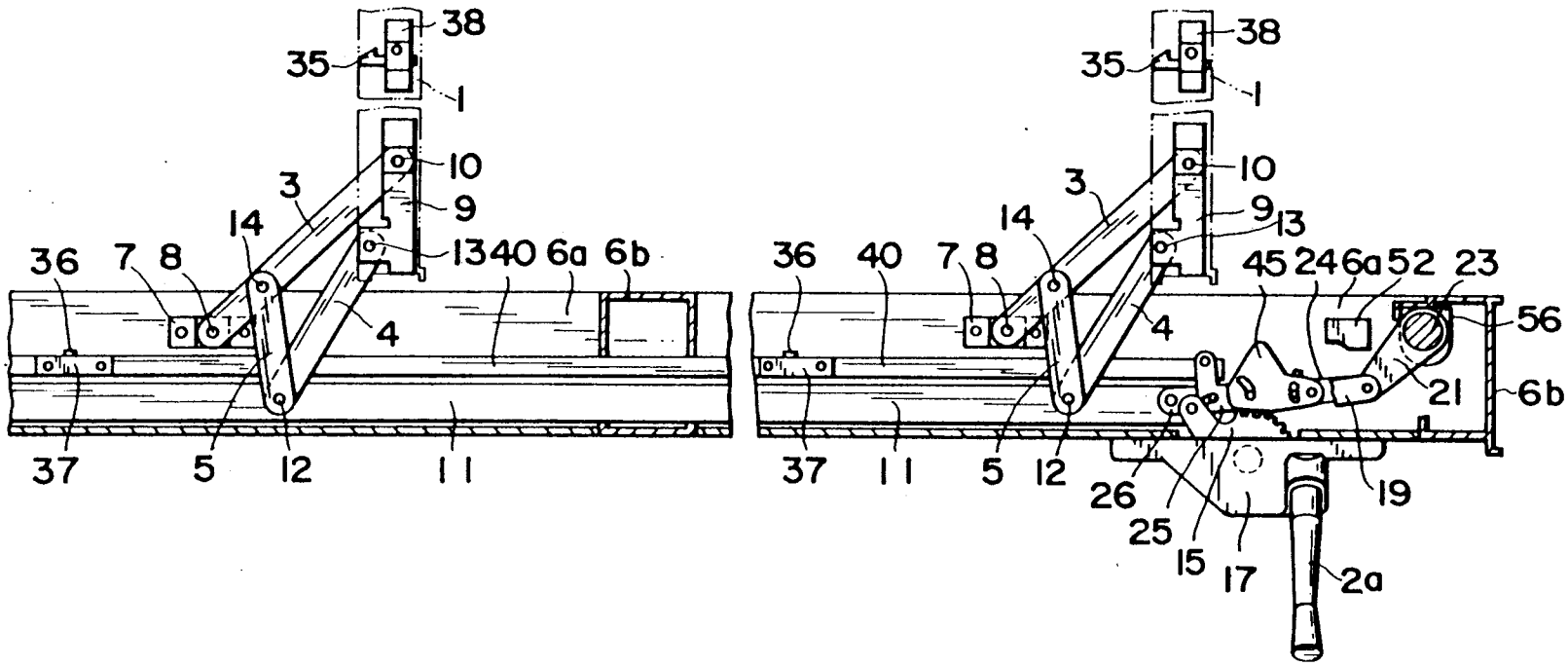
FIG. 9 is a plan view similar to FIG. 2, illustrating the window stay in a full open position.

Each window sash 1 is provided with the above described arms, namely, first arms 3 and 3*a*, second arms 4 and 4*a*, third arms, 5 and 5*a* and the above locking means, namely, the latches 35 and 35*a* and the locking bolts 37 and 37*a* each having the engaging portions 36 and 36*a*, between the top side of the window sash 1 and the top side 6*c* of the window frame and between the bottom side of the window sash 1 and the bottom side 6*a* of the window frame, as indicated, by the respective common reference numerals. Moreover, the second arms 4 and 4*a* and third arms 5 and 5*a* are pivotally attached to the respective driving rods 11 and 11*a* both incorporated within the bottom side 6*a* and the top side 6*c* of the window frame. Moreover, the locking bolts 37 and 37*a* are connected to the common acting rods 40 and 40*a* both incorporated at the bottom side 6*a* and the top side 6*c* of the window frame. The plurality of window sashes can be thus opened or closed and also locked or unlocked (FIG. 9).

What is claimed is:

1. A window comprising, a rectangular window frame having oppositely disposed horizontal top and bottom sides and oppositely disposed vertical sides; a first driving rod and a first acting rod associated with one of the horizontal sides of the window frame and reciprocable in a longitudinal direction of said one horizontal side; a first window sash disposed parallel to one of the vertical sides of the window frame and having a top side and a bottom side; and a first window stay including a first arm having one end pivotally attached to said one horizontal side of the window frame and its other end pivotally attached to the bottom side of the window sash, said first arm effective to swing the window sash about a point of attachment of the first arm to said window frame as the first driving rod is actuated, a second arm having one end pivotally attached to the bottom side of the window sash and its other end pivotally attached to the first driving rod, said second arm effective to swing the window sash about the point of attachment of the first arm to the window sash as the driving rod is actuated, and a third arm having one end pivotally attached to the first arm intermediate both ends of the first arm and its other end pivotally attached to the first driving rod, said third arm effective to swing the first arm together with the window sash about the point of attachment of the first arm to the window frame as the first driving rod is actuated; a first locking means for locking the window sash in a closed position and for unlocking said window sash and including a latch provided on the bottom side of the window sash and a locking bolt fixed on the first acting rod for engaging with the latch and for releasing from the latch by reciprocation of the first acting rod; operating means associated with the horizontal sides of the window frame for reciprocating the first driving rod and the first acting rod; and a differential means provided between the operating means and both the first driving rod and the first acting rod for moving the first driving rod and the locking bolt relatively with a time difference therebetween in order to make the locking bolt engage with or release from the latch in a closed position of the window sash; said differential means being effective, when the locked window sash is opened, to move the first acting rod prior to the first driving rod for releasing the locking bolt from the latch to unlock, and, when the window sash is closed to be locked, to make the first acting rd delayed with respect to the first driving rod near the closed position of the window sash to engage the locking bolt with the latch; said differential means comprising a second connecting rod moved together with said operating means to reciprocate the first acting rod; a third connecting rod moved with said second connecting rod to reciprocate the first driving rod; said second and third connecting rods being connected to effect a time difference between the first acting rod and the first driving rod by fitting in a relatively slidable form an elongated slot of the second connecting rod and a pin of the third connecting rod; a swing plate pivotally attached to the first connecting rod, said swing plate having an arcuate slot which has a center at the pivotal center and an elongated slot extending substantially radially from one end of the arcuate slot, said arcuate sot effective to prevent relative movement of the second and third connecting rods to move the second and third connecting rods integrally by fitting with a pin, said elongated slot effective to allow relative movement of the second and third connecting rods by fitting with said pin of the third connecting rod a spring constantly urging the swing plate to rotate in a direction such that the pin of the third connecting rod moves relatively from the elongated slot to the arcuate slot; and a cam swings the swing plate such that the pin of the third connecting rod moves relatively from the arcuate slot to the elongated slot against the spring or toward the opposite direction associated with the rotating power of the spring.

2. The window according to claim 1, wherein the operating means comprises a crank handle rotatably mounted on said one horizontal side of the window frame; a worm attached to an inner end of said crank handle; a worm wheel drivable by said worm; and a driving arm extending radially from said worm wheel.

3. The window according to claim 2, which further includes a housing attached to said one horizontal side of the window frame for mounting the crank handle thereon, and worm and worm wheel being disposed in said housing.

4. The window according to claim 3, which includes further a transmitting shaft; a first crank arm fixed to the bottom end of the transmitting shaft; a transmitting rod connecting said driving arm to said first crank arm for operation of said transmitting shaft upon rotation of said crank handle; and a first connecting rod connecting the first crank arm to the first connecting rod.

5. The window according to claim 4, wherein the transmitting shaft extends vertically through one of the vertical sides of the window frame between the two horizontal sides of the window frame, the transmitting shaft being combined with another horizontal side of the window frame, said another horizontal side having a second driving rod and a second acting rod both reciprocable in a longitudinal direction of said another horizontal side; a second window stay cooperative with the to side of the window sash corresponding to the first window stay; a second crank arm fixed on a top end of the transmitting shaft; a fourth connecting rod connected to the second crank arm; a fifth connecting rod for the second acting rod connected to said fourth connecting rod; a sixth connecting rod for the second driving rod connected to said fifth connecting rod; means for defining a connection between the fifth connecting rod and the sixth connecting rod having a play allowing operation differentially of the second driving rod and the second acting rod; a swing plate pivotally attached to the fifth connecting rod for effecting relative and integral movement on the second driving rod and the second acting rod; and a cam and a spring for pivotally swinging the swing plate, so that the first and second driving rods and the first and second acting rods individually move at the same time by operation of the transmitting shaft.

6. The window according to claim 5, wherein the window further comprises a first mounting plate fixed to said one horizontal side of the window frame at the point of attachment of the first arm to the window frame, and a second mounting plate fixed to the bottom side of the window sash at the respective points of attachment of the first arm and the second arm to said window sash.

7. The window according to claim 5, which includes at least one other window sash corresponding to the first window sash and arranged in parallel side-by-side relation thereto, a window stay corresponding to the first window stay associated with a bottom side of each other window sash and a locking means associated with the bottom side of each other window sash, whereby the window sashes move in unison upon operation of the first driving rod and are locked or unlocked in unison upon operation of the first acting rod.

8. The window according to claim 5, wherein each horizontal side of the window frame is substantially hollow in cross section, the first driving rod and the first acting rod being disposed within the one bottom horizontal side and the first window stay being positioned within said one hollow horizontal side and extensible therefrom, and the second driving rod and the second acting rod being disposed within said other hollow horizontal side and the second window stay also being disposed within said other hollow horizontal side and extensible therefrom.

9. The window according to claim 8, wherein said one vertical side of the window frame is essentially hollow in cross section and encloses said transmitting shaft.

* * * * *